United States Patent [19]

Cumming et al.

[11] 4,144,815

[45] Mar. 20, 1979

[54] REMOTE SETTABLE FUZE INFORMATION LINK

[75] Inventors: Allen R. Cumming, Towson, Md.; Clyde O. Peterson, Pittsburgh, Pa.

[73] Assignee: Westinghouse Electric Corp., Pittsburgh, Pa.

[21] Appl. No.: 321,405

[22] Filed: Jan. 5, 1973

[51] Int. Cl.[2] ..... F42C 13/00; F42C 15/40; F42C 11/04

[52] U.S. Cl. ..... 102/214

[58] Field of Search ..... 102/70.2 R, 70.2 P, 102/214

[56] References Cited

U.S. PATENT DOCUMENTS 2,640,417 6/1953 Bjork et al. ..... 102/70.2 R 3,417,700 12/1968 Furlani ..... 102/70.2 R

*Primary Examiner*—Samuel W. Engle
*Assistant Examiner*—Thomas H. Webb
*Attorney, Agent, or Firm*—D. Schron

[57] ABSTRACT

A system permitting VT (Variable Time) fuze setting information to be transmitted thereto from a remote fire control source via a microwave link when the fuze is chambered in a gun barrel prior to the firing of an artillery shell to which the fuze is affixed. Sufficient microwave power is initially transmitted to the fuze by means of the barrel acting as a microwave transmission line wherein the microwave power received is converted to a DC voltage which is stored and used to bias the fuze circuitry which subsequently receives binary detonating data AM modulated on a microwave carrier.

10 Claims, 2 Drawing Figures

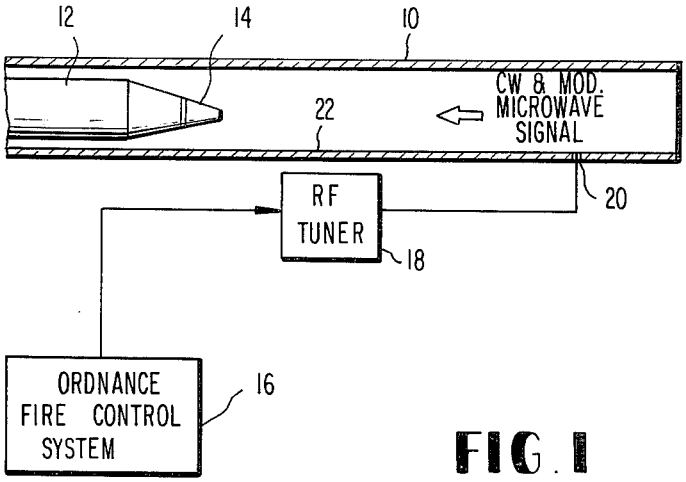
FIG. 1
FIG. 2
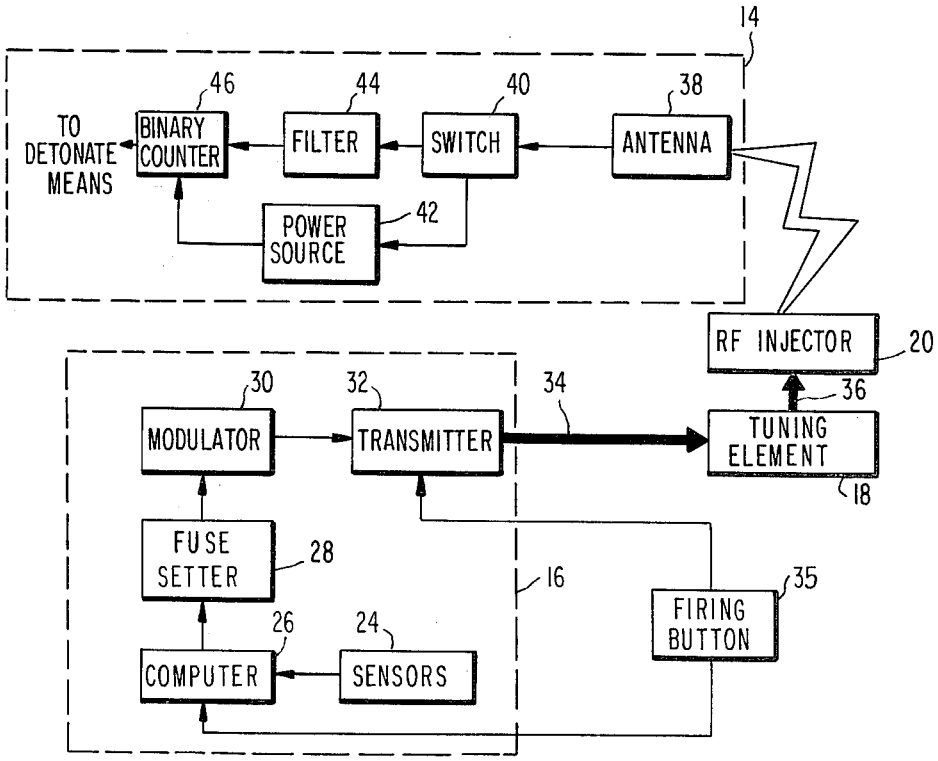

REMOTE SETTABLE FUZE INFORMATION LINK

BACKGROUND OF THE INVENTION

The present invention relates to ordnance devices and more particularly to means for arming and setting electronic VT fuzes with detonate information prior to firing.

Various techniques have been investigated for initially setting an electronic time fuze on a projectile when the projectile is chambered in a gun barrel. Specifically, the problem is to provide sufficient power to the fuze to energize and bias the fuze circuitry so that arm and detonate information can be transmitted to and received by the fuze from a fire control computer while the projectile is chambered in the gun. Techniques investigated include the use of X-rays, acoustics, optics, magnetics, and mechanical hardware. The technique that provided the solution was found within the microwave technology and forms the basis of the subject invention.

SUMMARY

The present invention is directed to means for transmitting power and fuze setting data to VT fuze receiver electronics prior to "setback" because afterwards every gun barrel contains a certain amount of propellant materials escaping ahead of the projectile which creates an ionized gas through which microwave energy cannot pass. More particularly, the system includes a fire control computer receiving information from various fire control sensors and transmits suitable information to a fuze setter section the binary output of which is coupled to an RF modulator and transmitter. An RF tuning device is connected to the transmitter and couples a microwave signal to an RF injector probe mounted in the wall of the gun barrel. The gun barrel itself acts as a microwave waveguide which couples RF energy from the injector probe to a VT fuze mounted on a projectile in the gun barrel. Fuze DC power which is converted from an initial CW burst of energy and setting information generated by the computer is transmitted to the fuze only after a fire button or other such means has been depressed, thereby assuring positive commitment of projectile expulsion from the gun barrel to the target.

BRIEF DESCRIPTION OF THE DRAWINGS

FIG. 1 is a diagram partially in section illustrating the inventive concept taught by the subject invention;

FIG. 2 is an electrical block diagram of the preferred embodiment of the subject invention.

DESCRIPTION OF THE PREFERRED EMBODIMENT

Whereas the setting of an electronic VT fuze for an artilery projectile has heretofore taken place prior to the fuze being mated to the projectile, it now becomes desirable to provide the initial setting of detonating data when the projectile is chambered in a gun barrel. Specifically, the problem is to provide sufficient power to energize the fuze and bias the fuze circuitry so that detonating information can be transmitted thereto from a remote fire control system prior to "setback", i.e. projectile firing. For reasons of personnel safety prior to setback there must be no internal power available in the fuze; therefore, power must be supplied from a source external to the fuze in order to permit suitable arming and detonating information to be coupled thereto.

Therefore, the present invention is directed to a system providing a remote settable fuze information link capable of transmitting both power to energize the fuze electronics and the fuze setting data from a fire control computer to the fuze on a projectile while the projectile is chambered in the gun barrel. Referring now to FIG. 1 which broadly discloses the inventive concept of the subject invention, reference numeral 10 designates an artilery gun barrel having a projectile 12 located therein. The projectile 12 has an electronic VT (variable time) fuze 14 mounted on its nose position and conforms to the silhouette thereof. Prior to setback or firing of the projectile 12, a remote ordnance fire control system 16 couples arming and detonating information to the fuze 14 by means of an RF tuner 18 which couples microwave signals modulated with the desired setting information to an RF injector probe 20 located in the wall of the gun barrel 10 forwardly of the projectile. The probe 20 is adapted to penetrate through the wall of the gun barrel, whereupon the microwave signals from the RF tuner 18 is coupled to the fuze 14 by means of the inner wall 22 of the gun barrel 10 which acts as a waveguide for microwave energy.

Fuze DC power and setting information is transmitted thereto only after a firing button, not shown, has been depressed, thereby assuring positive commitment of projectile expulsion from the gun barrel 10 to the target. It is to be noted also that gun crew safety is additionally provided in the normal manner through the existing fuze interlocks which require setback before the fuze can physically arm or detonate. Transmission of power and fuze setting data to the electronics portion of the fuze 14 is essential prior to setback because thereafter, every gun barrel contains a certain amount of propellant materials escaping ahead of the projectile which creates a ionized gas through which microwave energy cannot pass. This is particularly true after the barrel has been worn down and also in those guns which are capable of launching both conventional projectiles and guided missiles through the same bore.

Referring now to FIG. 2 which discloses the details of the preferred embodiment of the subject invention, the fire control system 16 is disclosed in block diagrammatic form and includes, inter alia, suitable weapon system sensors 24 which determine the target parameters including range, velocity, direction, air temperature, humidity, etc. This information in turn, is fed to a fire control computer 26 which is adapted to calculate the required fuze detonate data. The data is coupled to a fuze setting circuit 28 which generates a binary signal which is fed to an RF modulator 30. The modulator 30 is coupled to an RF transmitter 32 the output of which is coupled to a microwave tuning element 18 by means of a coaxial cable 34. The fire control system 16 is adapted to operate in conjunction with a firing button 35 or some such device which causes the transmitter portion 32 to generate an initial burst of CW microwave energy followed by a microwave carrier pulse which is for example amplitude modulated by the binary data from the fuze setter circuitry 28. The initial CW signal followed by the modulated microwave carrier is coupled to the coaxial cable 34 and to the tuning element 18. The tuning element is coupled to the RF injector probe 20 by means of a second coaxial cable 36. The microwave signals are fed to the VT fuze 14 by means of the gun barrel 10 which acts as a microwave waveguide.

The fuze 14 which is shown in block diagrammatic form in FIG. 2 includes a receiver portion comprised of a microwave antenna, an RF activated switch 40, a power source 42, a microwave filter 44 and a binary counter 46.

The CW and the binary modulated microwave signal which is injected into the gun barrel 10 shown in FIG. 1 by means of the injector probe 20 is coupled to the antenna 38. The CW burst of energy activates the switch 40 and is then coupled to the power source 42 which is adapted to convert the CW energy into a DC voltage which is stored and distributed to the binary counter 46 and the additional fuze circuitry, not shown. The binary counter 46 being energized by the power source 42 is then adapted to receive and respond to the detonating information contained on the modulated microwave signal. The modulated microwave signal upon being received at the antenna 38 is coupled through the switch 40 to the filter 44 which acts as a detector to demodulate the microwave signal and thus the original binary fuze setting information is transmitted to the counter 46. This is all accomplished a short time prior to actual setback of the projectile also initiated by the firing button 34.

As a further illustration of the subject concept, reference to Table I below illustrates typical losses which are encountered in order to transmit sufficient microwave power to the fuze 14 for accomplishing the setting operation.

TABLE I

| | |
|---|---|
| Coaxial Cable | 1.0db |
| RF Injector Probe | 20.0db |
| Propagation Loss in Barrel | 3.0db |
| Barrel Attenuation | 0.2db |
| Antenna Receiving to Barrel Waveguide Area Loss | 10.0db |
| Antenna Efficiency | 6.0db |
| Polarization Loss | 3.0db |
| Microwave to DC Conversion Loss | 13.9db |
| | 57.1db |

With a system as disclosed in FIGS. 1 and 2, there is no electrical energy source in the fuze prior to actuation of the firing button 34. Thus, utilization of the information link provides both the required fuze bias power and detonate data prior to setback, thereby solving longstanding problems. Resistance to electronic countermeasures and electromagnetic interference is extremely high due to the large quantities of power required at the fuze receiver end to operate it. Also the trend toward increasing capability in fire control computers makes the disclosed type of remote fuze setting highly desirable. Finally, utilization of a coaxial cable in a barrel wall coaxial RF injector provides maximum link security and effectiveness.

Having disclosed what is at present considered to be the preferred embodiment of the subject invention, we claim as our invention:

1. A system for supplying setting information from a fire control system to an electronic fuze mounted on a projectile chambered in a gun barrel prior to setback comprising in combination:

a source of microwave energy operated by said fire control system, said source generating microwave signals adapted to supply both DC power and fuze setting data to said fuze; and means coupling said microwave signals into said gun barrel intermediate the fuze and the muzzle of the barrel, said barrel being utilized as a microwave transmission line thereby.

2. A system for supplying setting information from a fire control system to an electronic fuze mounted on a projectile chambered in a gun barrel prior to setback comprising in combination:

a source of RF energy;

means coupled to said source of RF energy for initiating a burst of CW energy upon triggering projectile firing means;

means coupled to said source of RF energy for modulating said source with detonating information, and providing a modulated RF signal subsequent to said burst of CW energy;

means coupling said burst of CW energy and said modulated RF signal into said gun barrel, said gun barrel thereby acting as an RF transmission line;

first fuze circuit means responsive to said CW energy to provide an arming voltage for said fuze; and second fuze circuit means responsive to said modulated RF signal, being operable with said arming voltage to set said fuze with detonating information.

3. The system as defined by claim 2 wherein said RF source comprises a microwave source.

4. The system as defined by claim 3 wherein said coupling means comprises an RF injector probe located in the side of said gun barrel forward of said projectile.

5. The system as defined by claim 3 wherein said coupling means additionally includes RF tuning means.

6. The system as defined by claim 3 wherein said modulating means comprises pulse amplitude modulating means.

7. The system as defined by claim 3 wherein said fire control system includes means generating binary signals corresponding to the detonating information to be supplied to the fuze, and including means coupling said binary signals to said modulating means.

8. The system as defined by claim 7, wherein said second fuze circuit means includes binary counter means.

9. The system as defined by claim 8 wherein said second fuze circuit means additionally includes RF filter means coupled to the input of said binary counter means for demodulating said modulated RF signal.

10. The system as defined by claim 7 wherein said fire control system additionally includes a fire control computer coupled to said binary signal generating means.

* * * * *